US007424234B2

(12) United States Patent
Kim et al.

(10) Patent No.: US 7,424,234 B2
(45) Date of Patent: Sep. 9, 2008

(54) IMAGE PRINTER WITH COMMON FILTER TO FILTER COMMON OPERATING FREQUENCY BAND OF FIXING MODULE AND SWITCH MODE POWER SUPPLY MODULE

(75) Inventors: Jin-ha Kim, Seongnam-si (KR); Hwan-guem Kim, Seoul (KR); Durk-hyun Cho, Suwon-si (KR); Young-min Chae, Suwon-si (KR); Sang-yong Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 350 days.

(21) Appl. No.: 11/317,301

(22) Filed: Dec. 27, 2005

(65) Prior Publication Data

US 2006/0140691 A1 Jun. 29, 2006

(30) Foreign Application Priority Data

Dec. 28, 2004 (KR) ..... 10-2004-0113699

(51) Int. Cl.
*G03G 15/20* (2006.01)

(52) U.S. Cl. ..... 399/67; 219/216; 399/88; 399/328; 399/330

(58) Field of Classification Search ..... 399/67, 399/69, 37, 88, 320, 328, 329, 330; 219/216, 219/490, 619; 430/124.1
See application file for complete search history.

(56) References Cited

U.S. PATENT DOCUMENTS

| | | | | |
|---|---|---|---|---|
| 5,669,038 | A * | 9/1997 | Kishimoto | 399/67 |
| 6,545,255 | B2 * | 4/2003 | Sato et al. | 219/619 |
| 6,850,728 | B2 * | 2/2005 | Yokozeki et al. | 399/328 |

FOREIGN PATENT DOCUMENTS

| | | | |
|---|---|---|---|
| JP | 11-191483 | A * | 7/1999 |
| JP | 2001-5315 | | 1/2001 |
| JP | 2003-98882 | | 4/2003 |
| JP | 2003-177629 | A * | 6/2003 |
| JP | 2004-13077 | | 1/2004 |
| JP | 2004-37569 | | 2/2004 |
| KR | 2000-75716 | | 12/2000 |
| KR | 2001-19070 | | 3/2001 |
| KR | 2004-55364 | | 6/2004 |

* cited by examiner

*Primary Examiner*—Sophia S Chen
(74) *Attorney, Agent, or Firm*—Stanzione & Kim, LLP

(57) ABSTRACT

An image printer using a common filter to remove harmonic waves generated at a common operating frequency band of a fixing module to fix toner onto a print medium using high frequency power generated from a high frequency generator and a switch mode power supply module to supply operating power to the high frequency generator. The image printer includes a fixing module to fix toner to a print medium using high frequency power generated from a high frequency generator, a switch mode power supply module to supply operating power to the high frequency generator, and a band pass filter to filter harmonic waves of a common operating frequency band of the fixing module and the switch mode power supply module.

33 Claims, 7 Drawing Sheets

IMAGE PRINTER WITH COMMON FILTER TO FILTER COMMON OPERATING FREQUENCY BAND OF FIXING MODULE AND SWITCH MODE POWER SUPPLY MODULE

CROSS-REFERENCE TO RELATED APPLICATIONS

This application claims the benefit under 35 U.S.C. §119 of Korean Pat. Application No. 10-2004-113699, filed on Dec. 28, 2004, in the Korean Intellectual Property Office, the disclosure of which is incorporated herein in its entirety by reference.

BACKGROUND OF THE INVENTION

1. Field of the Invention

The present general inventive concept relates to an image printer, and more particularly, to an image printer in which a common filter is used to remove harmonic waves generated at a common operating frequency band of a fixing module to fix toner onto a print medium using high frequency power generated from a high frequency generator and a switch mode power supply module to supply operating power to the high frequency generator.

2. Description of the Related Art

FIG. 1 is a functional block diagram illustrating a conventional image printer in which a fixing module and a switch mode power supply module have separate filters for filtering harmonic waves of operating frequencies, respectively. Referring to FIG. 1, the conventional image printer includes a power source 110, a first filter 120, a second filter 130, a rectifier 140, a high frequency generator 150, a fixing part 160, a third filter 170, and a switch mode power supply (SMPS) part 180. The power source 110, the first filter 120, the second filter 130, the rectifier 140, the high frequency generator 150, and the fixing part 160 constitute the fixing module. The power source 110, the first filter 120, the third filter 170, and the switch mode power supply part 180 constitute the switch mode power supply module. The power source 110 supplies an AC current having a predetermined magnitude and frequency. The first filter 120 filters harmonic components generated during conversion of the AC current into a DC current. The AC current supplied from the power source 110 is converted into the DC current by the rectifier 140. The high frequency generator 150 is supplied with the DC current and generates a high frequency AC current. The generated high frequency AC current is supplied to the fixing part 160 having a heating part 165. The heating part 165 generates heat with resistance or inductance by using the high frequency AC current. A toner fixing part 168 fixes toner to a print medium by using the generated heat.

The switch mode power supply part 180 rectifies and converts the AC current supplied from the power source 110 into a DC current and generates a high frequency current necessary for the high frequency generator 150 of the fixing module from the converted DC current by using a high frequency generator (not shown).

Since the fixing module and the switch mode power supply module have different operating frequency bands, the fixing module and the switch mode power supply module have the second and third filters 130 and 170 for filtering the harmonic waves generated in the operating frequency bands thereof, respectively. However, when the temperature of the fixing part 160 is sensed and the frequency of the high frequency current supplied from the fixing part 160 is controlled according to the sensed temperature of the fixing part 160, the operating frequency of the high frequency current generated from the high frequency generator 150 varies in a predetermined frequency band. Accordingly, if the fixing module and the switch mode power supply modules operate at a common operating frequency band, it is possible to use one filter to filter harmonic waves of the common operating frequency band.

SUMMARY OF THE INVENTION

The present general inventive concept provides an image printer which can filter harmonic waves in a common operating frequency band of a fixing module and a switch mode power supply module using one filter.

The present general inventive concept also provides an image printer which can filter harmonic waves in a common operating frequency band of a switch mode power supply module and a fixing module in which a fixing part and a power source are electrically insulated from each other by an insulating part.

Additional aspects of the present general inventive concept will be set forth in part in the description which follows and, in part, will be obvious from the description, or may be learned by practice of the general inventive concept.

The foregoing and/or other aspects of the present invention, may be achieved by providing an image printer comprising a fixing module to fix toner to a print medium using a high frequency current generated from a high frequency generator, a switch mode power supply module to supply operating power to the high frequency generator, and a band pass filter to filter harmonic waves of a common operating frequency band of the fixing module and the switch mode power supply module, wherein the fixing module rectifies an input AC current supplied through the band pass filter to generate the high frequency current and fixes the toner to the print medium by generating heat using the generated high frequency current, and the switch mode power supply module rectifies the AC current supplied through the band pass filter to generate a current necessary to operate the high frequency generator and supplies the generated current to the high frequency generator.

The fixing module may comprise a rectifier to convert the AC current supplied from the band pass filter into a DC current, the high frequency generator to convert the DC current supplied from the rectifier into the high frequency current, a heating part to generate heat with resistance or inductance using the high frequency current, a toner fixing part to fix the toner to the print medium using the heat generated by the heating part, and a controller to sense a temperature of the toner fixing part and to control a frequency of the high frequency current generated by the high frequency generator to keep the toner fixing part at a predetermined temperature.

The image printer may further comprise a first filter which is disposed between an input power source to supply the input AC power and the band pass filter and to filter a harmonic component generated during conversion of the AC current into the DC current in the rectifier.

The image printer may further comprise a second filter which is disposed at a front stage of the switch mode power supply module and which filters a harmonic component generated from the switch mode power supply module.

The fixing module may comprise a rectifier to convert the AC current supplied from the band pass filter into a DC current, the high frequency generator to convert the DC current supplied from the rectifier into the high frequency current, an insulating part to generate an induced current by using the high frequency current, a heating part to generate heat with resistance or inductance using the induced current, a toner fixing part to fix the toner to the print medium using the heat generated from the heating part, and a controller to sense a temperature of the toner fixing part and to control a frequency of the high frequency current generated from the high frequency generator to keep the toner fixing part at a reference temperature.

The image printer may further comprise a resonant capacitor disposed between the heating part and the high frequency generator to resonate with an inductance component of the heating part. The image printer may further include a third filter disposed between the insulating part and the resonant capacitor to filter a harmonic component generated by the resonance of the resonant capacitor with the inductance component.

The foregoing and/or other aspects of the present general inventive concept may also be achieved by providing an image forming apparatus, including a high frequency generator to receive an input current and to generate a current having a first high frequency in a predetermined frequency band using the received input current, a fixing unit to generate heat using the generated current generated by the high frequency generator to fix toner to a print medium, a switch mode power supply unit to receive the input current, to generate a power supply current having a second high frequency in the predetermined frequency band using the received input current, and to supply the power supply current to the high frequency generator to power the high frequency generator, and a band pass filter to filter the input current at the predetermined frequency band and to output the filtered input current as the input current to the high frequency generator and the switch mode power supply unit to reduce harmonic waves in the current having the first high frequency and the power supply current having the second high frequency.

The foregoing and/or other aspects of the present general inventive concept may also be achieved by providing an image forming apparatus, including a band pass filter to filter an input AC current at a predetermined frequency band, a fixing module to use the filtered AC current to generate a first high frequency signal in the predetermined frequency band, and to use the generated first high frequency signal to generate heat to fix an image on a print medium, and a switch mode power supply module to use the filtered AC current signal to generated a second high frequency signal in the predetermined frequency band and to supply the second high frequency signal to the fixing module to power the fixing module.

The foregoing and/or other aspects of the present general inventive concept may also be achieved by providing a high frequency generation unit usable with a fixing unit of an image forming apparatus, the high frequency generating unit including a high frequency generator to operate at a predetermined operating frequency and to generate a high frequency current, a switch mode power supply to operate at the same predetermined operating frequency as the high frequency generator and to supply the high frequency generator with operating power, and a band pass filter to filter harmonic waves in the predetermined operating frequency of the high frequency generator and the switch mode power supply.

The foregoing and/or other aspects of the present general inventive concept may also be achieved by providing a method of fixing an image to a print medium, including filtering an input current at a predetermined frequency band, generating a high frequency current in the predetermined frequency band using the filtered input current in a high frequency generator, generating a power supply current in the predetermined frequency band using the filtered input current and supplying the power supply current to the high frequency generator, and generating heat using the high frequency currency and applying the generated heat to the print medium to fix the image thereon.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
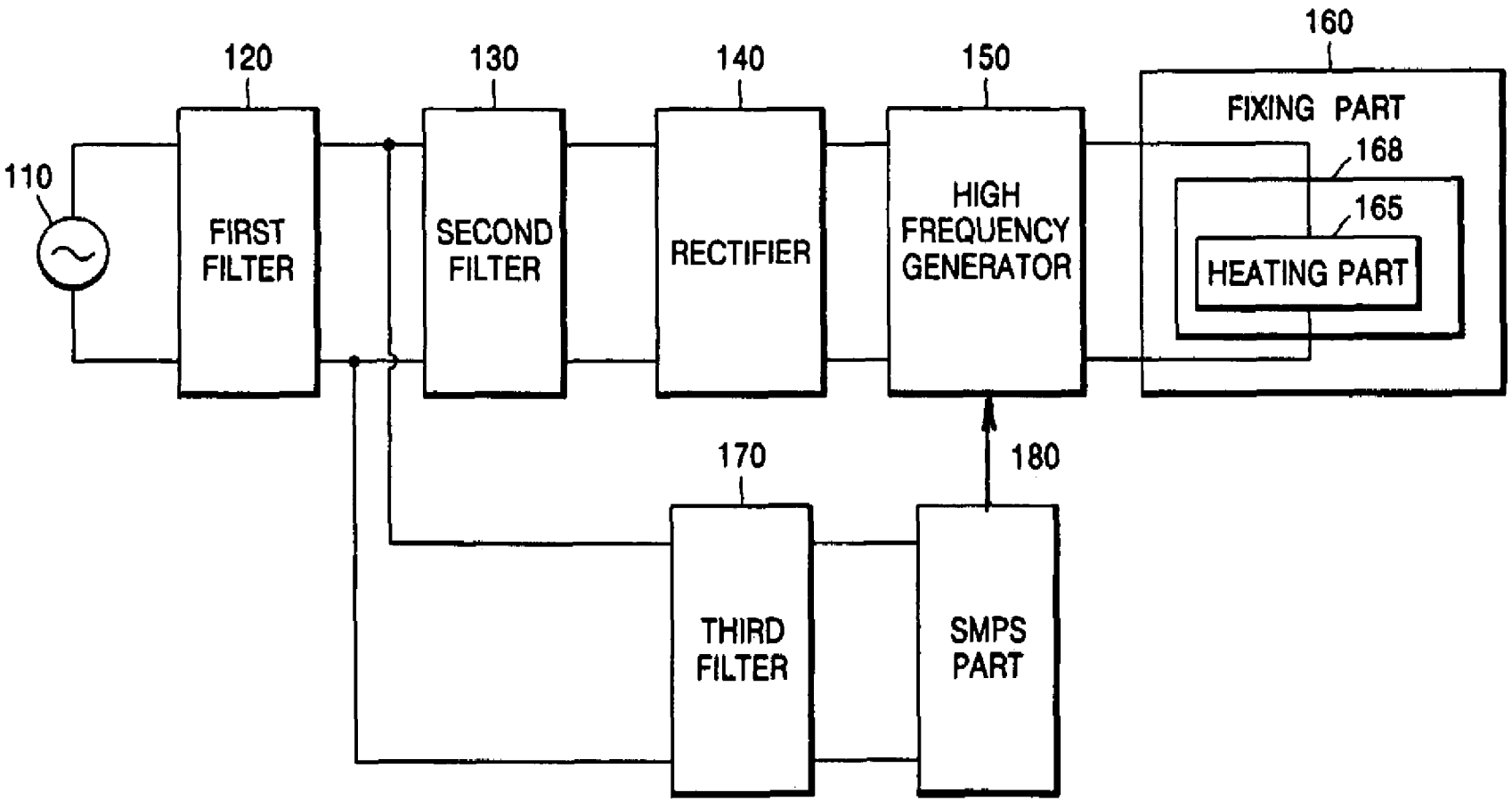
FIG. 1 (PRIOR ART)
FIG. 1 is a functional block diagram illustrating a conventional image printer in which a fixing module and a switch mode power supply module have separate filters for filtering harmonic waves of operating frequencies, respectively.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
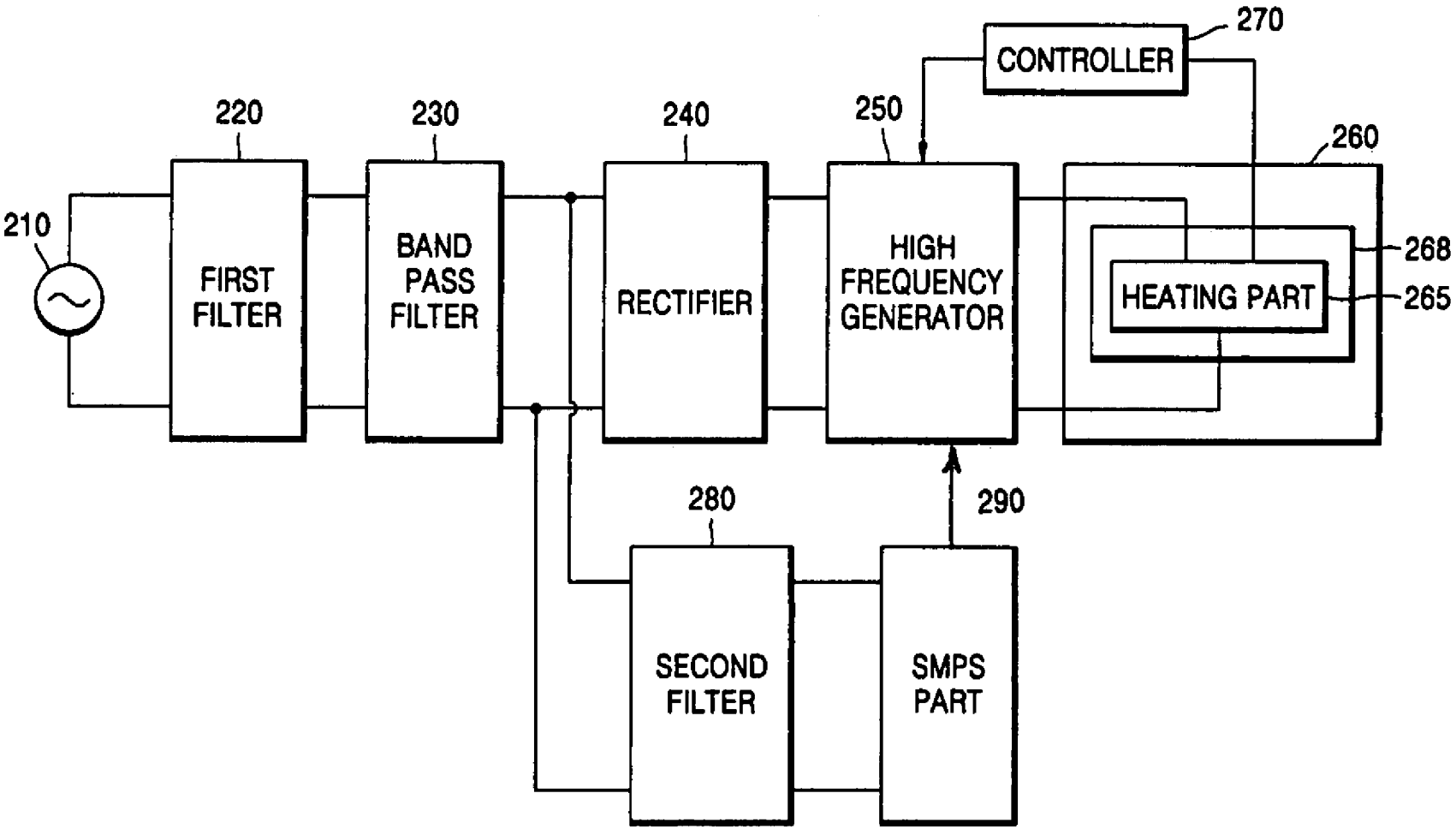
FIG. 2 is a functional block diagram illustrating an image printer in which a fixing module and a switch mode power supply module share a common filter to filter a common operating frequency thereof according to an embodiment of the present general inventive concept.

FIG. 2 is a functional block diagram illustrating an image printer or an image forming apparatus in which a fixing module and a switch mode power supply module share a common filter to filter a common operating frequency thereof according to an embodiment of the present general inventive concept. Referring to FIG. 2, the image printer includes a power source 210, a first filter 220, a band pass filter 230, a rectifier 240, a high frequency generator 250, a fixing part 260, a controller 270, a second filter 280, and a switch mode power supply part 290. Here, the rectifier 240, the high frequency generator 250, the fixing part 260, and the controller 270 may constitute a fixing module and the second filter 280 and the switch mode power supply part 290 may constitute a switch mode power supply (SMPS) module.

The power source 210 supplies an AC current with a predetermined magnitude and frequency to the first filter 220. For example, the first filter 220 can include an inductor and a capacitor to filter the AC current supplied by the power source 210 to reduce harmonic components generated during conversion of the AC current to a DC current in the fixing module and the switch mode power supply module.

The band pass filter 230 filters harmonic waves in an operating frequency band including an operating frequency band of the fixing module and an operating frequency band of the switch mode power supply module. For example, when the operating frequency band of the high frequency generator 250 of the fixing module ranges from 90 kHz to 250 kHz, the operating frequency band of the switch mode power supply module is designed to be within the operating frequency band of high frequency generator 250 of the fixing module. Accordingly, the SMPS part 290 of the switch mode power supply module and the high frequency generator 250 of the fixing module can share a common operating frequency band which corresponds to the operation frequency band of the fixing module and the SMPS module. That is, the harmonic waves corresponding to the common operating frequency band can be removed by the band pass filter 230.

The rectifier 240 rectifies the AC current supplied from the band pass filter 230 to generate a DC current. For example, the rectifier 230 can include four diodes (not illustrated) to rectify the AC current to generate the DC current according to polarities of the four diodes. However, this is not intended to limit the present general inventive concept, and other types of rectifiers may be used to rectify the AC current to generate the DC current.

Figure 7:
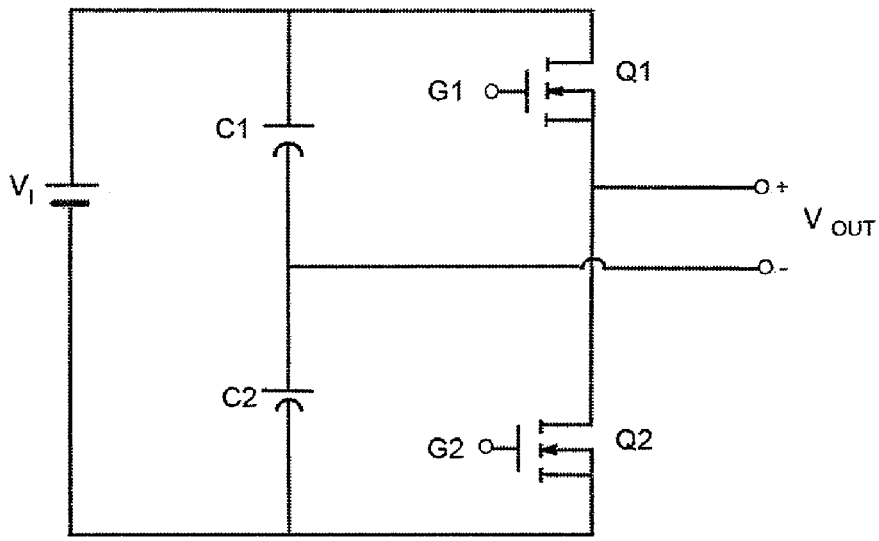
FIG. 7 is a view illustrating a high frequency generator.

The high frequency generator 250 generates a high frequency AC current of a first predetermined frequency band (i.e., the operating frequency band of the high frequency generator 250) from the DC current supplied from the rectifier 240. For example, the high frequency generator 250 may be a half-bridge inverter including two capacitors C1 and C2 and two field effect transistors Q1 and Q2 (referring to FIG. 7). Referring to FIG. 7, a pulse width modulating signal generated from the controller 270 is input to gates G1 and G2 of the field effect transistors Q1 and Q2, respectively. In FIG. 7, V1 denotes a voltage corresponding to the DC current supplied from the rectifier 240 and Vout denotes a voltage corresponding to the high frequency AC current of the first predetermined frequency band. The field effect transistors Q1 and Q2 alternately operate according to the input pulse width modulating signal to generate the high frequency AC current. This is not intended to limit the present general inventive concept, and other types of high frequency generators may be used as the high frequency generator 250 depending upon technical fields to which the present general inventive concept is applied.

The fixing part 260 includes a heating part 265 to generate heat with resistance or inductance using the high frequency AC current generated from the high frequency generator 250. A toner fixing part 268 of the fixing part 260 fixes toner to a print medium using the heat generated from the heating part 265. The heating part 265 may be a coil, but other types of heating parts may be used depending upon technical fields to which the present general inventive concept is applied.

The controller 270 senses a temperature of the toner fixing part 268, compares the sensed temperature of the toner fixing part 268 with a target temperature of the toner fixing part 268, and generates a reference current to adjust the temperature of the toner fixing part 268 to match the target temperature based on the comparison result. The controller 270 generates a pulse width modulating signal according to the reference current and supplies the pulse width modulating signal to the high frequency generator 250. The target temperature of the toner fixing part 268 can be a predetermined temperature of the toner fixing part suitable to fix the toner to the print medium. Operations of the controller 270 to generate the pulse width modulating signal are described in greater detail below with reference to FIG. 4.

The switch mode power supply (SMPS) part 290 rectifies the AC current supplied from the band pass filter 230 to convert the AC current into DC current, and converts the DC current into a high frequency current of a second predetermined frequency band (i.e., the operation frequency band of the switch mode power supply module) to supply power necessary to operate the high frequency generator 250 and other elements of the image printer. The predetermined frequency band of the high frequency current supplied from the switch mode power supply module is included within the first predetermined frequency band, which is the operating frequency band of the high frequency generator 250 of the fixing module. The switch mode power supply module may further comprise a second filter 280 to filter harmonic waves generated from the switch mode power supply part 290. The harmonic waves removed by the second filter 280 may be different from the harmonic waves removed by the band pass filter 230. That is, the harmonic waves removed by the second filter 280 may be harmonic waves outside of the operation frequency band.

In the image printer according to the embodiment of FIG. 2, the controller 270 generates the pulse width modulating signal according to the temperature of the toner fixing part 268, and the frequency of the high frequency AC current generated by the high frequency generator 250 is changed within the operating frequency band of the high frequency generator 250 according to the generated pulse width modulating signal. By designing the operating frequency band of the switch mode power supply module to be within the operating frequency band of the high frequency generator 250, it is possible to filter harmonic waves of the common operating frequency band of the fixing module and the switch mode power supply module by using a single filter, such as the band pass filter 230.

Figure 3:
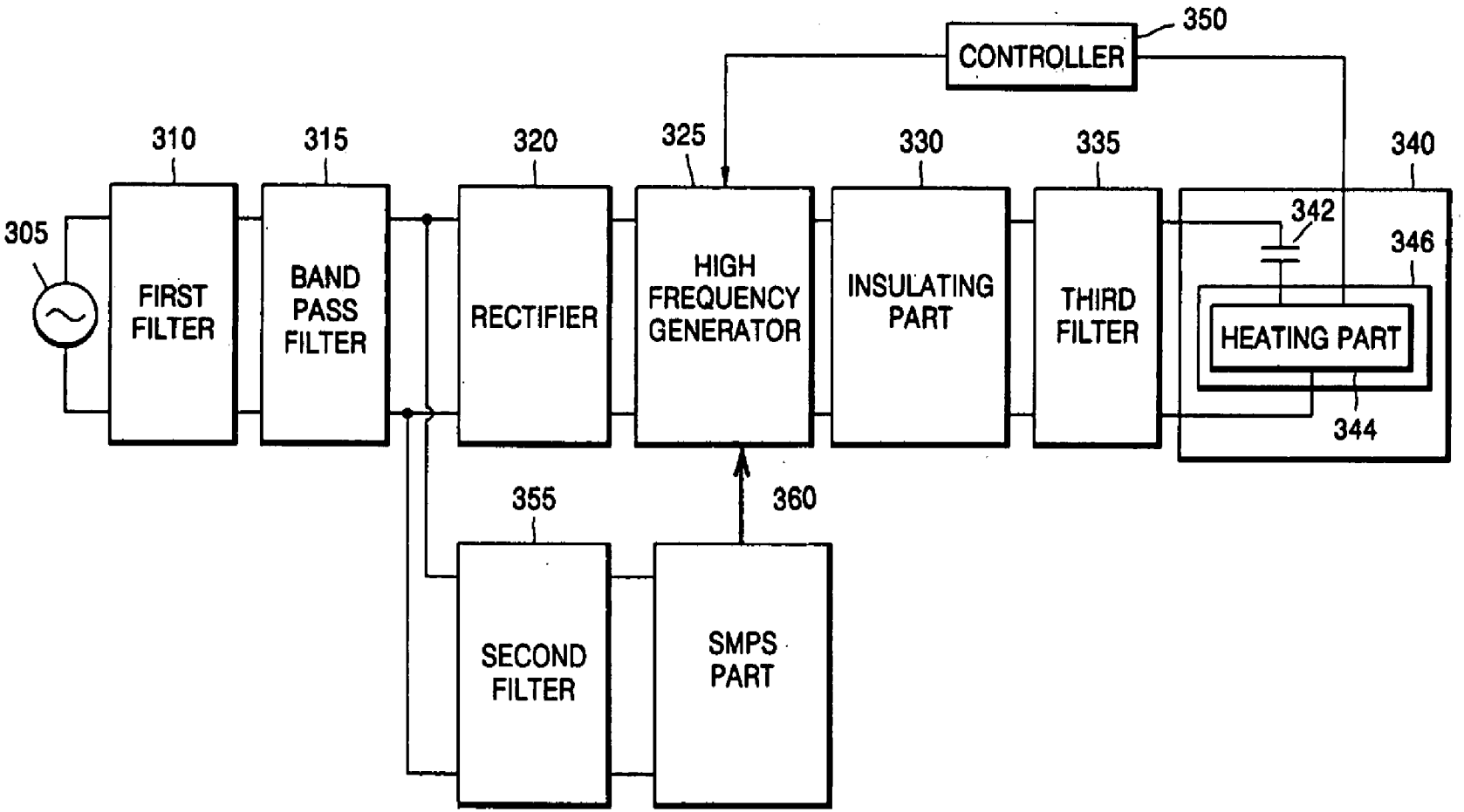
FIG. 3 is a functional block diagram illustrating an image printer in which a fixing module and a switch mode power supply module share a common filter to filter a common operating frequency thereof according to another embodiment of the present general inventive concept.

FIG. 3 is a functional block diagram illustrating an image printer in which a fixing module and a switch mode power supply module share a common filter to filter a common operating frequency thereof according to another embodiment of the present general inventive concept. Referring to FIG. 3, the image printer includes a power source 305, a first filter 310, a band pass filter 315, a rectifier 320, a high frequency generator 325, an insulating part 330, a third filter 335, a fixing part 340, a controller 350, a second filter 355, and a switch mode power supply part 360. Since the power source 305, the first filter 310, the band pass filter 315, the rectifier 320, the high frequency generator 325, the controller 350, the second filter 355, and the switch mode power supply part 360 of the embodiment of FIG. 3 operate in substantially the same way as the power source 210, the first filter 220, the band pass filter 230, the rectifier 240, the high frequency generator 250, the controller 270, the second filter 280, and the switch mode power supply part 290 of the embodiment of FIG. 2, respectively, descriptions thereof are omitted.

The high frequency AC current generated from the high frequency generator 325 is supplied to the insulating part 330. The insulating part 330 generates an induced current using the AC current generated from the high frequency generator 325. The induced current generated from the insulating part 330 is supplied to the fixing part 340. As illustrated in FIG. 3, a transformer can be exemplified as the insulating part 350.

When the high frequency AC current flows through a primary coil (not shown) of the transformer 330, a magnetic field is varied around a secondary coil (not shown) and thus the induced current is generated in the secondary coil due to the variation of the magnetic field. The induced current generated by the transformer 330 is supplied to a heating part 344 of the fixing part 340. A magnitude of the induced current can be controlled by a turn ratio of the primary coil (not shown) and the secondary coil (not shown). Since the induced current generated from the transformer 330 instead of the current of the power source 305 is supplied to the secondary coil, the power source 305 and the fixing part 340 are electrically separated.

The fixing part 340 includes the heating part 344 which generates heat with resistance or inductance using the induced current generated from the insulating part 330. The toner fixing part 346 fixes toner to a print medium by using the generated heat. A thin insulating layer (not shown) to prevent the heating part 344 from directly contacting the toner fixing part 346 can be interposed between the toner fixing part 346 and the heating part 344. The heating part 344 can be a coil and the coil has predetermined inductance and resistance components. The fixing part 340 may further comprise a capacitor 342 which resonates with the inductance component. The third filter 335 can be disposed between the insulating part 330 and the resonant capacitor 342 and to filter harmonic components generated due to the resonance of the capacitor 342 and the inductance component. The third filter 335 can be a Y-shaped capacitor.

Figure 4:
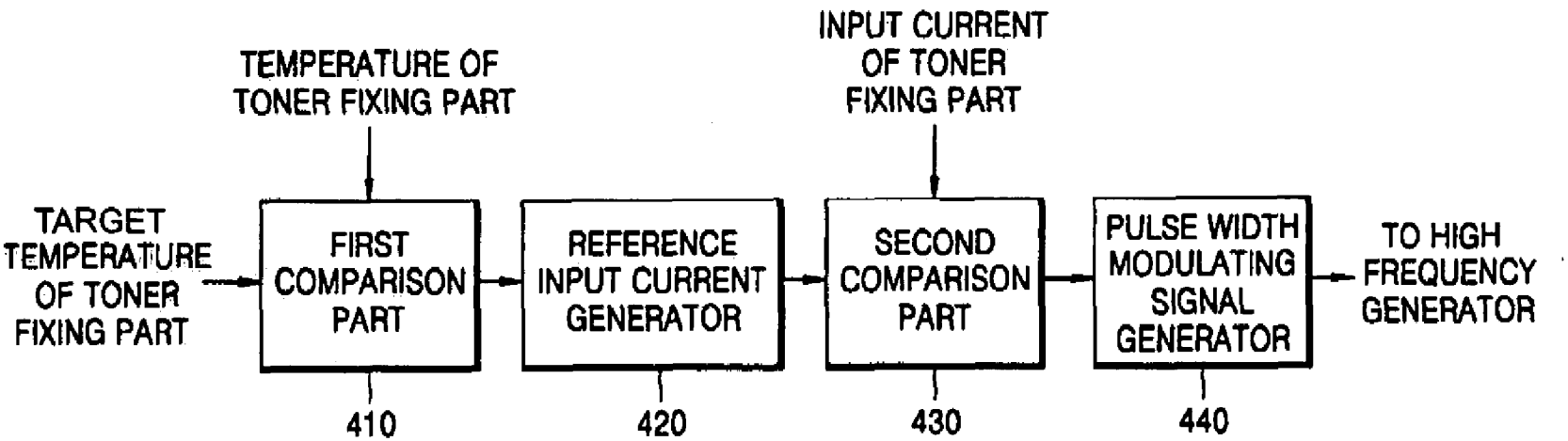
FIG. 4 is a functional block diagram illustrating a controller according to an embodiment of the present general inventive concept.

FIG. 4 is a functional block diagram illustrating the controller 270 or 350 according to an embodiment of the present general inventive concept. Referring to FIG. 4, the controller 270 or 350 can include a first comparison part 410, a reference input current generator 420, a second comparison part 430, and a pulse width modulating signal generator 440.

The first comparison part 410 compares the temperature of the toner fixing part 268 or 346 with the target temperature of the toner fixing part 268 or 346. The reference input current generator 420 generates the reference current to adjust the temperature of the toner fixing part 268 or 346 to match the target temperature based on the difference between the sensed temperature of the toner fixing part 268 or 346 and the target temperature of the toner fixing part 268 or 346. The second comparison part 430 calculates a magnitude difference between the current actually input to the toner fixing part 268 or 346 and the generated reference current. The pulse width modulating signal generator 440 generates a pulse width modulating signal to compensate for a magnitude difference between the current actually input to the toner fixing part 268 or 346 and the reference current, and supplies the generated pulse width modulating signal to the high frequency generator 250 or 325.

As the frequency of the generated pulse width modulating signal becomes lower, an AC current of a relatively low frequency band is generated from the high frequency generator 250 or 325. As the AC current has a lower frequency, a larger current is supplied to the heating part 265 or 344. Therefore, the pulse width modulating signal generator 440 generates the pulse width modulating signals having different frequencies to keep the toner fixing part 268 or 346 at the target temperature, and supplies the pulse width modulating signals to the high frequency generator 250 or 325.

Figure 5A:
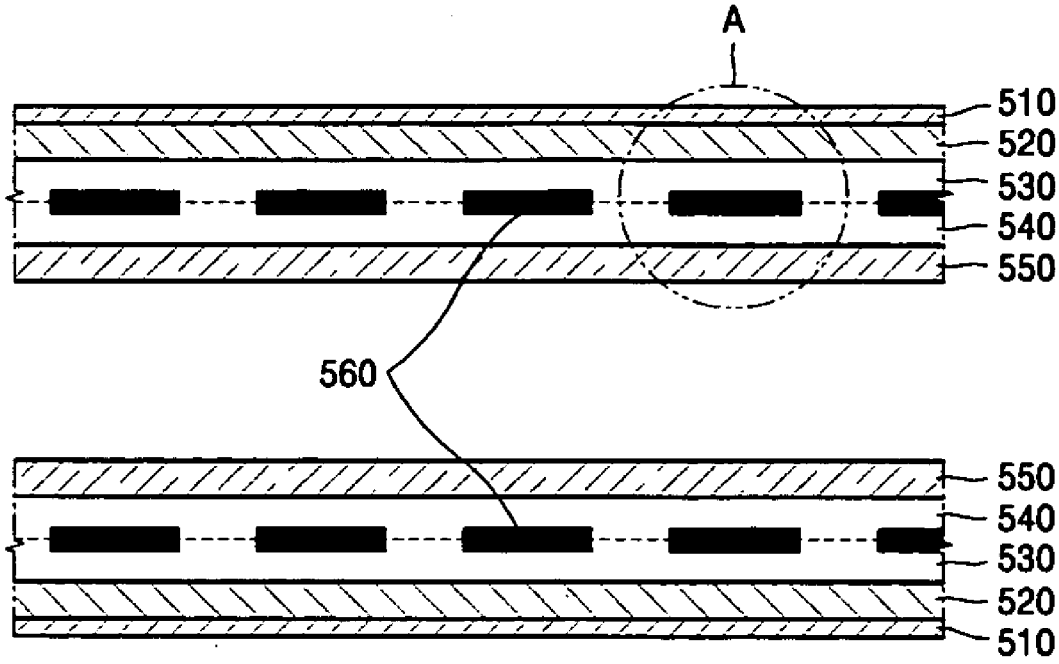
FIGS. 5A and 5B are cross-sectional views illustrating a fixing part according to an embodiment of the present general inventive concept.
Figure 5B:
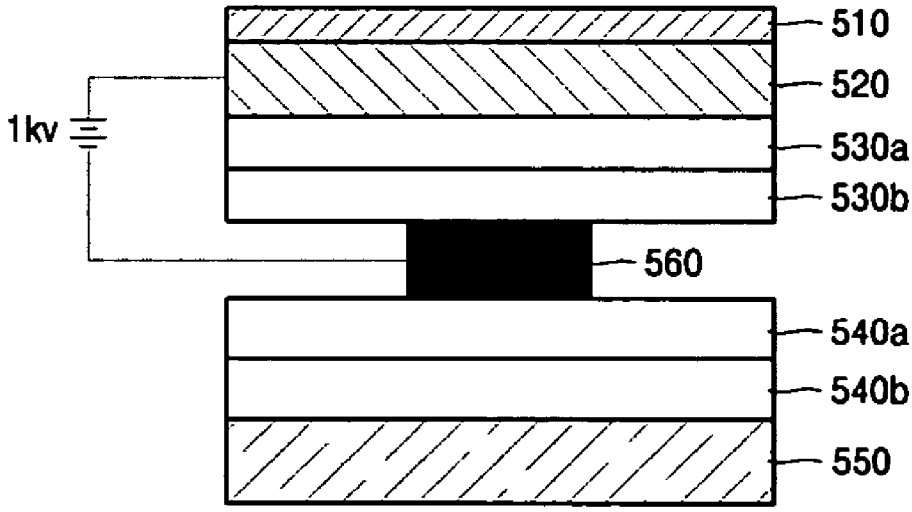

FIGS. 5A and 5B are cross-sectional views illustrating the fixing part 260 or 340 according to an embodiment of the present general inventive concept. FIG. 5A illustrates a lateral cross-sectional view of the fixing part 260 or 340, and FIG. 5B illustrates in detail the heating part of the fixing part 260 or 340 indicated by a circle A of FIG. 5A, and a fixing roller 520 and insulating layers 530 and 540 illustrated as an example of the toner fixing part 268 or 346 in the present embodiment.

Referring to FIG. 5A, the fixing part 260 or 340 includes a cylindrical fixing roller 520 on which a protective layer 510 coated with Teflon or the like is formed, a pipe-shaped enlarged contact part 550 of which both ends are open and which is provided inside the fixing roller 520, and a heating part 560 disposed between the fixing roller 520 and the enlarged contact part 550. The heating part 560 spirally surrounds the enlarged contact part 550 and generates heat using a current from an external power source. The insulating layers 530 and 540 surround the heating part 560 and prevent the heating part from contacting the fixing roller 520 and the enlarged contact part 550.

Although the fixing roller 520 is exemplified as a toner fixing part 268 or 346 to fix the toner in the fixing part 260 or 340 in FIG. 5A, the present general inventive concept is not limited to this, and other types of toner fixing parts may be used depending upon the technical fields to which the present general inventive concept is applied.

The heating part 560 can be a coil. However, the present general inventive concept is not limited to this, and other types of heating parts may be used depending upon the technical fields to which the present general inventive concept is applied.

The coil 560 generates heat with resistance by receiving a first induced current generated from the transformer 330 (see FIG. 3). The first induced current generated from the transformer 330 is an AC current corresponding to the high frequency AC current input to the transformer 330. When the first induced current is input to the coil 560, alternating magnetic flux corresponding to the first induced current is generated around the coil 560. The generated alternating magnetic flux is transferred to the fixing roller 520 and the fixing roller 520 generates a second induced current (eddy current) in a direction in which the variation of the transferred alternating magnetic flux is prevented. The fixing roller 520 may be made of copper alloy, aluminum alloy, nickel alloy, iron alloy, chrome alloy, magnesium alloy, or the like. Since the fixing roller 520 has a specific resistance, the fixing roller 520 generates heat with the resistance by the second induced current. It is by induction heating that the fixing roller 520 generates heat by the second induced current. However, the present general inventive concept is not limited to this, and the fixing roller 520 may be made of other materials depending upon the technical fields to which the present general inventive concept is applied.

The heating part 560 may be made of copper alloy, aluminum alloy, nickel alloy, iron alloy, chrome alloy, magnesium alloy, or the like, which can have a resistance of 100 Ω or less across both ends, so that the resistance heating is caused by a resistance loss of the heating part 560 at the time of input of the current. However, the present general inventive concept is not limited to this, and the heating part 560 may be made of other materials depending upon the technical fields to which the present general inventive concept is applied.

The insulating layers 530 and 540 include a first insulating layer 530 disposed between the fixing roller 520 and the heating part 560 and a second insulating layer 540 disposed between the heating part 560 and the enlarged contact part 550. The first and second insulating layers 530 and 540 may be made of mica, polyimide, ceramic, silicon, polyurethane, glass, PTFE (polytetrafluoruethylene), or the like. However, the present general inventive concept is not limited to the above-mentioned materials, and the first and second insulating layers 530 and 540 may be made of other materials depending upon the technical fields to which the present general inventive concept is applied.

FIG. 5B illustrates an area A of FIG. 5A in more detail. Referring to FIGS. 5A and 5B, the first insulating layer 530 is disposed between the heating part 560 and the fixing roller 520. The first insulating layer 530 prevents the heating part 560 from contacting the fixing roller 520. That is, the first insulating layer 530 is interposed between the heating part 560 and the fixing roller 520 to prevent contact between the heating part 560 and the fixing roller 520. A withstanding voltage of the first insulating layer 530 can be 1 kV or less. In order to satisfy the withstanding voltage requirement of 1 kV or less, the first insulating layer 530 of the fixing part 260 or 340 can be made of, for example, a mica sheet 530*a* with a thickness of approximately 0.1 mm to prevent the heating part 560 from contacting the fixing roller 520. In order to prevent the heating part 560 from contacting the fixing roller 520 when the mica sheet with the thickness of approximately 0.1 mm is destroyed, two mica sheets 530*a* and 530*b* each with the thickness of approximately 0.1 mm may be used. Similarly, the second insulating layer 540 prevents the heating part 560 from contacting the enlarged contact part 550. The second insulating layer 540 can also be made of one or more mica sheets 540*a* and 540*b* each with the thickness of approximately 0.1 mm.

As the thickness of the first insulating layer 530 disposed between the fixing roller 520 and the heating part 560 increases, the heat generated from the heating part 560 is not efficiently delivered to the fixing roller 520. Therefore, as the thickness of the first insulating layer 530 decreases, the heat generated from the heating part 560 can be more efficiently delivered to the fixing roller 520. The material and thickness of the first insulating layer 530 described above do not limit the present general inventive concept, and the first insulating layer may have other materials and thicknesses.

Figure 6A:
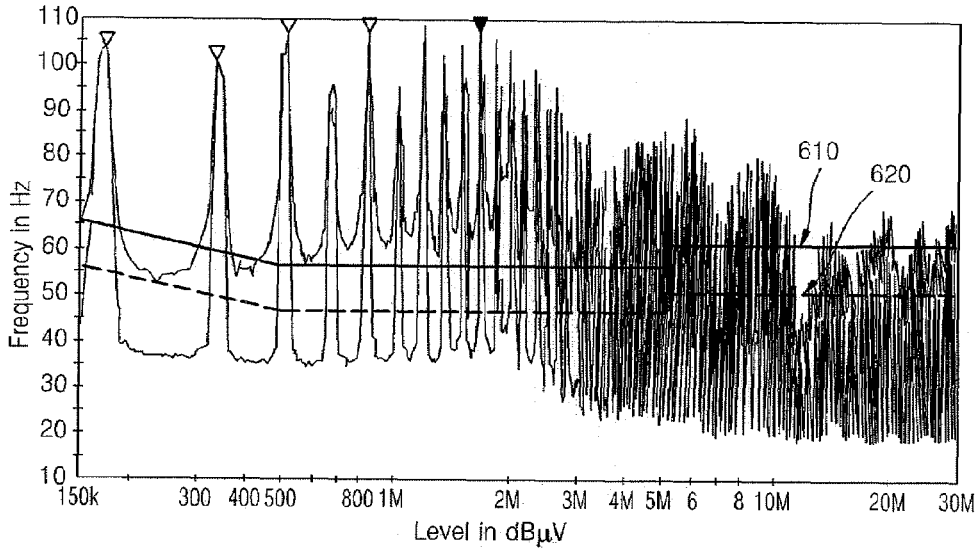
FIG. 6A (PRIOR ART)
FIGS. 6A and 6B are views illustrating harmonic waves filtered by a filter of the conventional image printer and a filter according to an embodiment of the present general inventive concept.
Figure 6B:
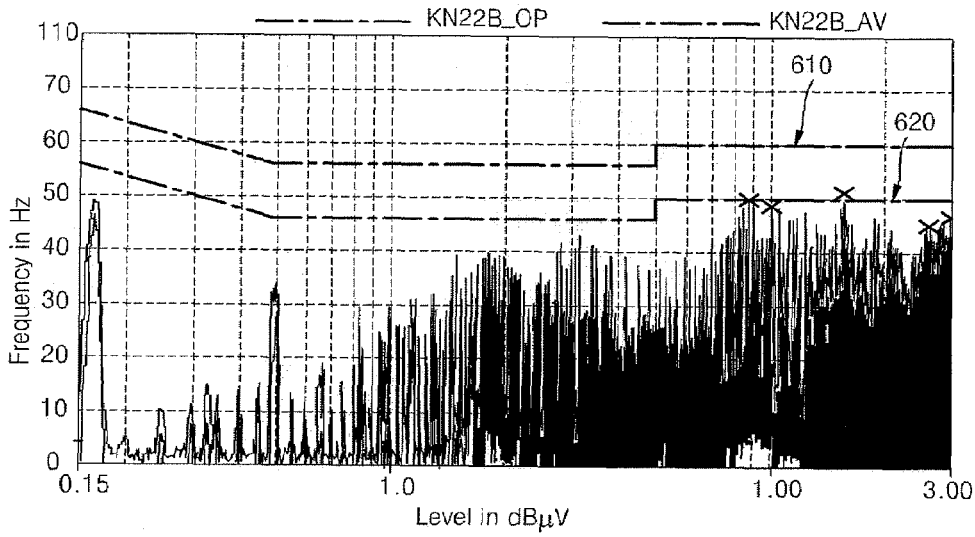

FIGS. 6A and 6B illustrate harmonic waves in an operating frequency band of a high frequency generator, which is filtered by filters used in the conventional image printer and filtered in the band pass filter 230 or 315 according to an embodiment of the present general inventive concept, respectively. FIG. 6A illustrates the harmonic waves filtered by the filters used in the conventional image printer. As illustrated in FIG. 6A, the conventional filter does not completely filter even harmonic waves and odd harmonic waves in the operating frequency band of the high frequency generator and thus even harmonic waves and odd harmonic waves in excess of predetermined harmonic wave filtering standards 610 and 620 are generated. On the other hand, as illustrated in FIG. 6B, the band pass filter 230 or 315 and the third filter 355 according to an embodiment of the present general inventive concept completely filter the even harmonic waves and the odd harmonic waves in the operating frequency band of the high frequency generator, thereby satisfying the harmonic wave filtering standards 610 and 620.

In the image printer according to the embodiments of the present general inventive concept, which includes a fixing module to fix toner to print media using high frequency power generated from the high frequency generator and a switch mode power supply module to supply operating power to the high frequency generator, one band pass filter can simultaneously filter harmonic waves in the operating frequency band of the fixing module and the switch mode power supply module, by designing the operating frequency band of the switch mode power supply module with reference to the operating frequency band of the fixing module.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image printer comprising:

a fixing module to fix toner to a print medium using a high frequency current generated from a high frequency generator;

a switch mode power supply module to supply operating power to the high frequency generator; and a band pass filter to filter harmonic waves of a common operating frequency band of the fixing module and the switch mode power supply module, wherein the fixing module rectifies an input AC current supplied through the band pass filter to generate the high frequency current and fixes the toner to the print medium by generating heat generated using the generated high frequency current, and the switch mode power supply module rectifies the input AC current supplied through the band pass filter to generate a current necessary to operate the high frequency generator and supplies the generated current to the high frequency generator.

2. The image printer according to claim 1, wherein the fixing module comprises:

a rectifier to convert the input AC current supplied through the band pass filter into a DC current;

the high frequency generator to convert the DC current supplied from the rectifier into the high frequency current;

a heating part to generate the heat with resistance or inductance using the high frequency current;

a toner fixing part to fix the toner to the print medium using the heat generated from the heating part; and a controller to sense a temperature of the toner fixing part and to control a frequency of the high frequency current generated by the high frequency generator to control the toner fixing part to have a predetermined temperature.

3. The image printer according to claim 2, wherein the controller comprises:

a first comparison part to compare the temperature of the toner fixing part with a reference temperature;

a reference input current generator to generate a reference current input to the heating part to control the temperature of the toner fixing part to be the reference temperature based on the comparison result of the first comparison part;

a second comparison part to compare the reference current with the high frequency current actually input to the heating part; and a pulse width modulating signal generator to generate a pulse width modulating signal to compensate for a difference between the high frequency current actually input to the heating part and the reference current based on the comparison result of the second comparison part.

4. The image printer according to claim 3, wherein the high frequency generator comprises a half-bridge inverter, and the pulse width modulating signal generator supplies the generated pulse width modulating signal to a gate of the half-bridge inverter.

5. The image printer according to claim 3, wherein the toner fixing part comprises a fixing roller.

6. The image printer according to claim 2, further comprising:

a first filter disposed between an input power source that supplies the input AC current and the band pass filter and to filter a harmonic component generated during conversion of the input AC current into the DC current in the rectifier.

7. The image printer according to claim 2, further comprising:

a filter which is disposed at a front stage of the switch mode power supply module to filter a harmonic component generated from the switch mode power supply module.

8. The image printer according to claim 1, wherein the fixing module comprises:

a rectifier to convert the input AC current supplied through the band pass filter into a DC current;

the high frequency generator to convert the DC current supplied from the rectifier into the high frequency current;

an insulating part to generate an induced current using the high frequency current;

a heating part to generate heat with resistance or inductance using the induced current;

a toner fixing part to fix the toner to the print medium using the heat generated by the heating part; and a controller to sense a temperature of the toner fixing part and to control a frequency of the high frequency current generated from the high frequency generator to keep the toner fixing part at a reference temperature.

9. The image printer according to claim 8, wherein the controller comprises:

a first comparison part to compare the temperature of the toner fixing part with the reference temperature;

a reference input current generator to generate a reference current to input to the heating part to adjust the temperature of the toner fixing part to match the reference temperature based on the comparison result of the first comparison part;

a second comparison part to compare the reference current with the induced current actually input to the heating part; and a pulse width modulating signal generator to generate a pulse width modulating signal to compensate for a difference between the induced current actually input to the heating part and the reference current based on the comparison result of the second comparison part.

10. The image printer according to claim 9, wherein the high frequency generator comprises a half-bridge inverter and the generated pulse width modulating signal is supplied to a gate of the half-bridge inverter.

11. The image printer according to claim 9, wherein the toner fixing part comprises a fixing roller.

12. The image printer according to claim 8, further comprising:

a resonant capacitor disposed between the heating part and the high frequency generator and to resonate with an inductance component of the heating part.

13. The image printer according to claim 12, further comprising:

a filter disposed between the insulating part and the resonant capacitor to filter a harmonic component generated by the resonance of the resonant capacitor with the inductance component.

14. The image printer according to claim 13, wherein the filter comprises a Y-shaped capacitor.

15. The image printer according to claim 8, further comprising:

a first filter disposed between an input power source to supply the input AC current and the band pass filter and to filter a harmonic component generated during the conversion of the AC current into the DC current in the rectifier.

16. The image printer according to claim 8, further comprising:

a filter disposed at a front stage of the switch mode power supply module to filter a harmonic component generated from the switch mode power supply module.

17. The image printer according to claim 8, wherein the insulating part electrically insulates the high frequency generator and the heating part from each other.

18. The image printer according to claim 8, further comprising:

an insulating layer to insulate the heating part and the toner fixing part from each other, wherein a withstand voltage of the insulating layer is substantially 1 kV.

19. An image forming apparatus, comprising:

a high frequency generator to receive an input current and to generate a current having a first high frequency in a predetermined frequency band using the received input current;

a fixing unit to generate heat using the generated current generated by the high frequency generator to fix toner to a print medium;

a switch mode power supply unit to receive the input current, to generate a power supply current having a second high frequency in the predetermined frequency band using the received input current, and to supply the power supply current to the high frequency generator to power the high frequency generator; and a band pass filter to filter the input current at the predetermined frequency band and to output the filtered input current to the high frequency generator and the switch mode power supply unit as the input current to reduce harmonic waves in the current having the first high frequency and the power supply current having the second high frequency.

20. The image forming apparatus according to claim 19, further comprising:

a controller to control the high frequency generator according to a temperature of the fixing unit.

21. The image forming apparatus according to claim 20, wherein the controller compares the temperature of the fixing unit with a predetermined target temperature and controls the high frequency generator to adjust the first high frequency of the generated current according to the comparison.

22. The image forming apparatus according to claim 19, wherein the fixing unit comprises:

a heating member to receive the generated current generated by the high frequency generator and to generate heat using the received current; and a heat transfer member to transfer the generated heat to the print medium to fix the toner thereto.

23. The image forming apparatus according to claim 19, wherein the fixing unit comprises:

an induction unit to receive the generated current generated by the high frequency generator and to generate an induced current using the received current;

a heating member to generate the heat using the induced current; and a heat transfer member to transfer the generated heat to the print medium to fix the toner thereto.

24. The image forming apparatus according to claim 23, wherein the induction unit electrically insulates the high frequency generator and the heating member from each other.

25. The image forming apparatus according to claim 19, wherein the band pass filter reduces the harmonic waves in the current having the first high frequency and the power supply current having the second high frequency to be below one or more predetermined harmonic wave filtering standards.

26. An image forming apparatus, comprising:

a band pass filter to filter an input AC current at a predetermined frequency band;

a fixing module to use the filtered AC current to generate a first high frequency signal in the predetermined frequency band, and to use the generated first high frequency signal to generate heat to fix an image on a print medium; and a switch mode power supply module to use the filtered AC current signal to generate a second high frequency signal in the predetermined frequency band and to supply the second high frequency signal to the fixing module to power the fixing module.

27. The image forming apparatus according to claim 26, wherein the fixing module comprises:

a rectifier to convert the filtered AC current into a DC current;

a high frequency generator to generate the first high frequency signal in the predetermined frequency band using the DC current;

a fixing unit to generate heat by receiving the first high frequency signal;

a control unit to control a temperature of the fixing unit by adjusting the first high frequency signal generated by the high frequency generator.

28. The image forming apparatus according to claim 26, wherein the fixing module comprises:

a rectifier to convert the filtered AC current into a DC current;

a high frequency generator to generate the first high frequency signal in the predetermined frequency band using the DC current;

an induction unit to induce a heating current from the first high frequency signal;

a fixing unit to generate heat by receiving the inducing current; and a control unit to control a temperature of the fixing unit by adjusting the first high frequency signal generated by the high frequency generator.

29. A high frequency generation unit usable with a fixing unit of an image forming apparatus, the high frequency generating unit comprising:

a high frequency generator to operate at a predetermined operating frequency and to generate a high frequency current;

a switch mode power supply to operate at the same predetermined operating frequency as the high frequency generator and to supply the high frequency generator with operating power; and a band pass filter to filter harmonic waves in the predetermined operating frequency of the high frequency generator and the switch mode power supply.

30. The high frequency generation unit according to claim 29, wherein the band pass filter pre-filters an input AC current in the predetermined operation frequency and supplies the pre-filtered AC current to the high frequency generator and the switch mode power supply.

31. The high frequency generation unit according to claim 30, further comprising:

a rectifier to convert the pre-filtered AC current supplied to the high frequency generator from the band pass filter to a DC current and to supply the DC current to the high frequency generator.

32. The high frequency generation unit according to claim 31, wherein the high frequency generator converts the DC current supplied from the rectifier into the high frequency current and the switch mode power supply converts the operating power to be supplied to the high frequency generator.

33. A method of fixing an image to a print medium, comprising:

filtering an input current at a predetermined frequency band;

generating a high frequency current in the predetermined frequency band using the filtered input current in a high frequency generator;

generating a power supply current in the predetermined frequency band using the filtered input current and supplying the power supply current to the high frequency generator; and generating heat using the high frequency currency and applying the generated heat to the print medium to fix the image thereon.

* * * * *